US005642747A

United States Patent [19]

Rizzotti

[11] Patent Number: 5,642,747

[45] Date of Patent: Jul. 1, 1997

[54] HAND-HELD AERODYNAMIC UMBRELLA

[76] Inventor: Salvatore A. Rizzotti, 2 Elizabeth La., West Yarmouth, Mass. 02673

[21] Appl. No.: 712,771

[22] Filed: Sep. 12, 1996

Related U.S. Application Data

[63] Continuation-in-part of Ser. No. 383,796, Feb. 6, 1995, Pat. No. 5,555,903.

[51] Int. Cl.[6] ..... A45B 3/00

[52] U.S. Cl. ..... 135/16; 135/20.1; 135/33.2

[58] Field of Search ..... 135/16, 19, 20.1, 135/15.1, 31, 33.2

[56] References Cited

U.S. PATENT DOCUMENTS

| | | | |
|---|---|---|---|
| 2,756,760 | 7/1956 | Grotteria . | |
| 2,871,868 | 2/1959 | Faasse et al. . | |
| 2,905,187 | 9/1959 | Croce | 135/20.1 |
| 3,204,650 | 9/1965 | Shinew | 135/20.1 X |
| 3,304,035 | 2/1967 | Davis | 135/20.1 X |
| 3,486,514 | 12/1969 | Prescott | 135/20.1 X |
| 3,765,434 | 10/1973 | Riggs . | |
| 4,132,236 | 1/1979 | Petersen et al. . | |
| 4,347,862 | 9/1982 | Secon . | |
| 4,505,285 | 3/1985 | French . | |
| 5,555,903 | 9/1996 | Rizzotti . | |

*Primary Examiner*—Lanna Mai
*Attorney, Agent, or Firm*—William Nitkin

[57] ABSTRACT

An aerodynamic hand-held umbrella having a curved canopy mounted on a rotatable, horizontally disposed shaft which is hinged to a vertical pole, such canopy having a stabilizer member on the top thereof and being able to rotate the front of the umbrella into the wind.

5 Claims, 2 Drawing Sheets

HAND-HELD AERODYNAMIC UMBRELLA

This application is a continuation-in-part of my previous application, Ser. No. 08/383,796 filed Feb. 6, 1995 for an Aerodynamic Umbrella, now U.S. Pat. No. 5,555,903.

BACKGROUND OF THE INVENTION

1. Field of the Invention

The structure of this invention resides in the area of hand-held umbrellas and more particularly relates to an umbrella having aerodynamic features.

2. Description of the Prior Art

Umbrellas are usually concave, inverted, fabric-covered canopy structures supported by a plurality of struts and ribs mounted on a central mast. The designs of typical prior art umbrellas have been primarily limited to rounded, curved canopies so that they open symmetrically. Such umbrellas are often adversely affected by strong wind which can blow their canopies inside out, and many inventions have been directed to improving such umbrellas to better withstand strong winds such as by providing vents in their fabric covering or by providing pole structures which can allow wind to pass therethrough in various ways. Some umbrellas are spring-loaded, that is, their concave structures are movable when sufficient wind force is exerted thereon; and when such force is no longer present, the concave structures return to their normal position. One patio umbrella of the prior art spins on its central shaft when strong wind blows against it in order to dissipate the force of the wind. Despite the incorporation of such wind-resistant features, prior art hand-held canopy umbrellas are still adversely affected by strong winds which can turn their canopies inside-out.

Yet another negative of prior art umbrella structures is that their construction is labor-intensive because of their complicated construction utilizing many parts. Many times it is completely impractical to repair umbrellas because of the high cost of repairing their thin metal struts which can be bent by the force of high winds against the canopy. Thus, if damaged, such prior art umbrellas often must be thrown away.

SUMMARY OF THE INVENTION

It is an object of this invention to provide an aerodynamic umbrella which can withstand the force of strong winds against it by pivoting into the direction of the wind and allowing the wind to flow over and under its canopy. By incorporating aerodynamic principles in its design, the canopy of this umbrella is much more stable than the typical rounded canopy structures of the prior art and is of a much simpler construction, resulting in its being easier to manufacture because it has fewer parts. The key features of the umbrella of this invention are its rotatable keystone-shaped canopy and its unique supporting structure. The pole, having a right angle bend in it when the umbrella is opened, is comprised of a horizontally extending shaft which extends perpendicular to the lower vertical portion of the pole. The front end of the horizontally extending shaft is attached to the canopy-supporting structure. The right angle bend of the pole includes a hinged connection between the lower vertical pole and the horizontally extending shaft and includes structure to allow such horizontally extending shaft to rotate freely above the lower vertical portion of the pole.

The members of the support framework supporting the fabric canopy generally meet at a hinged junction at the front end of the horizontally extending shaft. First and second support members are disposed on the outer front sides of the canopy and are attached at the hinged junction, forming the nose of the umbrella canopy structure. Also attached to the hinged junction are first and second lateral rib members disposed inward of the first and second support members. Directly above the horizontally extending shaft is disposed the stabilizer support member with its front end attached to the hinged junction. Attached toward the front end of the stabilizer support member and disposed above it is a stabilizer rib member.

When the umbrella is opened, the first and second lateral rib members, the stabilizer support member and the first and second support member are pushed into place by struts attached at one end thereof to each member and at the struts' other end attached to a collar which can be manually moved along on the horizontally disposed shaft. The collar can be manually slid forward along the horizontally disposed shaft and locked into the open position when opening the umbrella and released and moved rearwardly when closing the umbrella. The horizontally extending shaft can be aligned with the lower pole by moving such shaft on its hinge to form a straight pole when the umbrella is folded up for storage.

The fabric of the canopy is attached or other attachment means to the canopy support structure along the first and second support members and can have pockets or equivalent retention means to retain the rear ends, respectively, of the first and second lateral rib members and the stabilizer support member. The first and second support member, the stabilizer support member and the first and second lateral rib members are bent into a curve by tensioning from pressure from the canopy fabric against their respective ends when the collar is moved forward, as described further below.

The first and second support members are disposed at an obtuse angle to one another and are swept back at a slight angle from the front toward the rear of the canopy. The lateral sides of the canopy are tapered rearward along their edges with the tension-curved lateral ribs and tensioned curved stabilizer support member, producing a fabric curvature at the front of the canopy. As the wind blows thereover, such curvature acts as an aerodynamic foil and causes a slight lifting effect on the front of the canopy yet keeping the canopy stable as the structure is directed to aim into the wind by the action of the wind on the upwardly extending stabilizer member. The shape of the canopy structure is such that the stabilizer member above the top center length of the canopy causes the rotatable umbrella to be directed so that the front of the canopy always faces into the wind. As the wind blows against the umbrella, the front of the canopy structure and the horizontally extending shaft rotate at its pivot point above the lower pole to pivot automatically into the direction of the wind.

DESCRIPTION OF THE PREFERRED EMBODIMENT(S)

Figure 1:
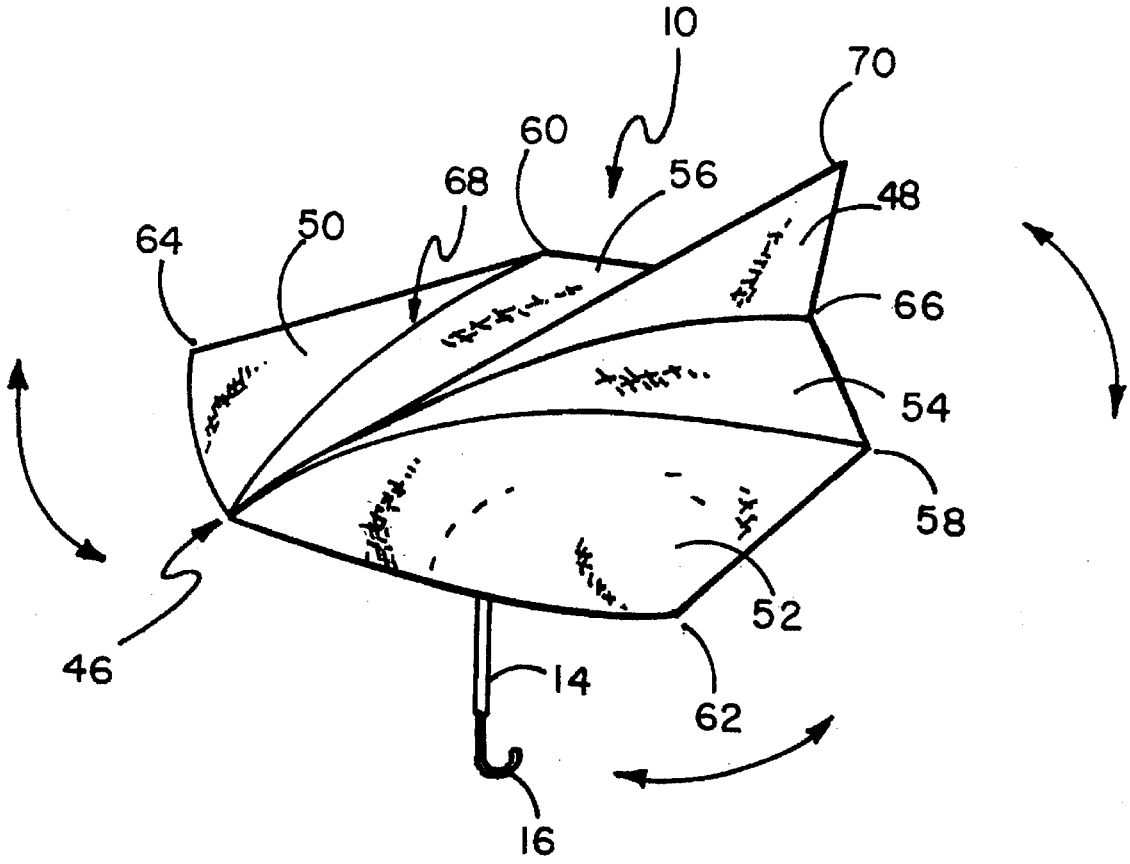
FIG. 1 illustrates a perspective view of the aerodynamic umbrella of this invention in its open mode with fabric canopy in place.

FIG. 1 illustrates a perspective view of umbrella 10 of this invention. Seen in this view is canopy 68 with stabilizer member 48 extending upward therefrom. Also seen is downwardly extending pole cover 14 and handle 16.

Figure 2:
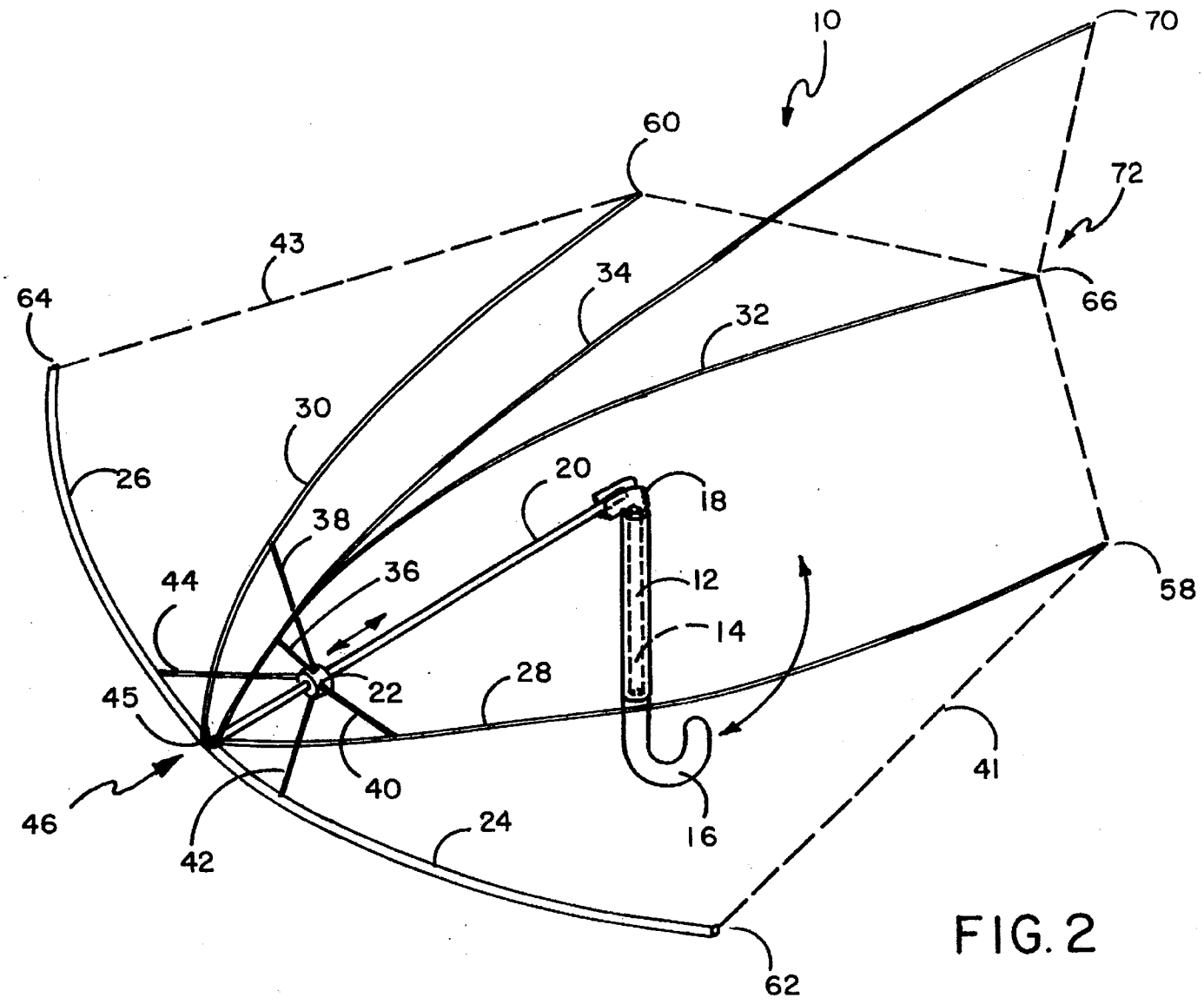
FIG. 2 illustrates a perspective view of the aerodynamic umbrella of FIG. 1 with the canopy depicted in outline form to illustrate the canopy support structure.

FIG. 2 illustrates an enlarged view of the umbrella of FIG. 1 with the canopy fabric shown only in dashed outlines so that the structural framework thereunder is visible. In FIG. 2 can be seen vertically disposed pole 12 attached to hinged connection 18. Around pole 12 is disposed pole cover 14 which allows pole 12 to rotate freely therein when pole cover 14 is grasped. Hinged connection 18 interconnects horizontally extending shaft 20 to pole 12 which in a first storage mode allows shaft 20 to be aligned with pole 12 and, in a second mode, allows shaft 20 to be moved on hinged connection 18 so that shaft 20 is disposed at a 90 degree angle to pole 12. Other equivalent structures can be utilized to enable shaft 20 to be disposed in either a horizontal or vertical position. In the position illustrated shaft 20 is freely rotatable above pole 12 when pole cover 14 is grasped. Other means to allow the rotation of shaft 20 above pole 12 can be utilized. Shaft 20 extends forward to a hinged junction 45 disposed at nose 46 at the front of umbrella 10. From hinged junction 45 extend first and second support members 24 and 26. Also extending from hinged junction 45 are first and second lateral rib members 28 and 30 which are substantially in the same horizontal plane as first and second support members 24 and 26. Also extending from hinged junction 45 is centrally disposed stabilizer support member 32 which extends from nose 46 to the rear of umbrella 10 over horizontally extending shaft 20, forming the base of stabilizer member 48. Stabilizer rib 34 can extend, in one embodiment, from hinged junction 45 or, in a second embodiment, from a forward position on stabilizer support member 32. Stabilizer rib 34 extends upwardly above stabilizer support member 32 to its end 70 which is disposed above end 66 of stabilizer support member 32. Extending between stabilizer rib 34 and stabilizer support member 32 is fabric forming stabilizer member 48, as seen in FIG. 1. Extending from first and second support members 24 and 26 over ends 58 and 60, respectively, of first and second lateral rib members 28 and 30 and continuing to cover centrally disposed stabilizer support member 32 over end 66 is fabric forming canopy 68. Stabilizer member 48, as seen in FIG. 1, is generally wedge-shaped, being shorter in height at its front and taller at its rear, has more surface area at its rear portion so as to cause the umbrella of this invention to act like a weather vane when wind blows against the structure, causing nose 46 at the front of the canopy always to rotate, pivoting on pole 12, to face into the wind. Canopy 68 is cut to be somewhat shorter than the length of lateral rib members 28 and 30 and stabilizer support member 32 so that when attached thereto, a blowing or bending in these ribs is created, giving canopy 68 a curved shape which causes a slight aerodynamic foil effect to occur, resulting in a slight lifting at such curvature while at the same time depressing rear 72 of the canopy by the flow of wind. These dual effects help to retain the canopy securely in place on its shaft and pole as it rotates within pole cover 14 to maintain its position facing into the wind. Stabilizer member 48 can be made of fabric or equivalent planar material which is sewn, glued or attached by well known equivalent means to stabilizer support member 32 and stabilizer rib 34. First side 41 and second side 43 of canopy 68 taper inward, respectively, from the outermost ends 62 and 64 of first and second support members 24 and 26 at the front of the canopy toward the ends 58 and 60 of first and second lateral ribs 28 and 30, respectively, at the rear of the canopy. The rearwardly angled first and second support members 24 and 26 and the inwardly tapered sides 41 and 43 give the canopy its distinctive keystone shape when viewed from above. The tensioned, curved lateral ribs and tension-curved stabilizer support member help to tension the surface of the canopy into its aerodynamic shape. Because first lateral rib member 28 and second lateral rib member 30 extending from hinged junction 45 are positioned away from end 66 of stabilizer support 32, the keystone shape of the canopy is maintained due to the fabric's tension existing from the ends 62 and 64 of the support members to the ends 58 and 60 of the rib members to the end 66 of stabilizer support member 32 causing the canopy's fabric's tension to be uniformly distributed so as to prevent any buckling of the canopy surface.

It should be noted that the canopy of the umbrella can be constructed other than a keystone shape while still maintaining its ability of rotate into the wind. The supporting members can be made of a lightweight, sturdy metal such as aluminum or other equivalent material including plastic or composite materials to provide a durable and economically produced structure. The umbrella of this invention is much less-labor intensive to produce when compared to many prior art umbrellas. The canopy of this invention can be constructed of a single piece of material or of multiple pieces of fabric, plastic or equivalent flexible material.

It is desirable that pole 12 be disposed a distance between the front and rear of the canopy so as to be centered thereunder to provide protection from the elements to the user of the umbrella of this invention.

To open or close the umbrella of this invention, assuming shaft 20 and pole 12 are aligned for storage and that the canopy is folded inward, one would first maneuver shaft 20 on hinged connection 18 so that it bends to form a right angle with pole 12. One then can grasp collar 22, which is hingeably attached to a plurality of struts as described below, and move collar 22 forward to extend the members of the canopy framework. Collar 22 is attached by first and second support member struts 42 and 44, respectively, to first and second support members 24 and 26. As collar 22 is moved forward on shaft 20, the inner ends of first and second support members 24 and 26 rotate on hinged junction 45, allowing the outer portions of first and second support members 24 and 26 to be moved laterally forward to their open positions. At the same time first and second lateral rib struts 40 and 38, also attached to collar 22 and to first and second lateral ribs 28 and 30, respectively, move first and second lateral ribs 28 and 30 away from shaft 20 and position them in their respective open positions, such positioning applying curvature to such lateral ribs to help in causing the tensioning of the fabric of the canopy over the structural framework. At the same time stabilizer strut 36, which is also hingeably attached to collar 22, extends to stabilizer support member 32. As collar 22 is moved forward, stabilizer strut 36 helps cause stabilizer support member 32 to bend upwards near its front, also contributing to apply tension to the canopy structure. When collar 22 is in its forwardly advanced open position, a manually disengageable locking member well-known in the art can hold it in place until the user is ready to release collar 22 and pull it rearward to cause the strut members attached to the support members, ribs and stabilizer support to pull inward and collapse the canopy for storage.

Although the present invention has been described with reference to particular embodiments, it will be apparent to those skilled in the art that variations and modifications can be substituted therefor without departing from the principles and spirit of the invention.

I claim:

1. An hand-held umbrella for use outdoors where wind conditions can occur, comprising:

a vertically disposed pole having a top;

a horizontally disposed shaft having a first end and a second end, said second end rotatably attached to said top of said pole, disposing said shaft perpedicular to said pole;

a canopy having a front portion and a rear portion;

means to attach said front portion of said canopy to said first end of said horizontally disposed shaft; and means to rotate said horizontally disposed shaft above said pole to allow said front portion of said canopy to face into the wind.

2. The hand-held umbrella of claim 1 wherein said canopy has a top and a length, said umbrella further including a centrally disposed stabilizer member extending upwards from said top of said canopy along said length of said canopy.

3. The hand-held umbrella of claim 2 further including:

a first support member having an inner end and an outer end and a second support member having an inner end and an outer end, said inner ends interconnected to said first end of said horizontally disposed shaft, forming a junction at such interconnection; and a stabilizer support having a first end positioned above said shaft, said first end interconnected to said junction.

4. The hand-held umbrella of claim 3 further including:

a first rib member having a first end, a second end and a length;

a second rib member having a first end, a second end and a length;

said first and second rib members attached at their first ends to said junction and attached at their second ends to said rear portion of said canopy, said first and second rib members to support and apply tension to said canopy to aid in causing curvature in said canopy, such curvature being higher at said front portion than at said rear portion.

5. The hand-held umbrella of claim 4 further including:

a collar member slideably positioned on said horizontally disposed shaft;

a plurality of strut members each having a first end and a second end, said first end of each strut member hingeably attached to said collar member, said second ends of said strut members each hingeably attached, respectively, to said first support member, said second support member, said first rib member, said second rib member and said stabilizer member;

wherein said collar member in a first closed mode is manually moved rearward, retracting said first and second support members, said first and second rib members and said stabilizer member inward toward said shaft; and wherein said collar member in a second open mode is manually moved forward, moving said first and second support members, said first and second rib members and said stabilizer support outward to their open position and wherein said shaft is hingeably attached to said pole, allowing movement of said shaft from a perpendicular position to said pole to an aligned parallel position to said pole.

* * * * *